US010981585B2

(12) United States Patent
Richter

(10) Patent No.: US 10,981,585 B2
(45) Date of Patent: Apr. 20, 2021

(54) RAIL VEHICLE WITH ARTICULATED CONNECTION

(71) Applicant: Hübner GmbH & Co. KG, Kassel (DE)

(72) Inventor: Olaf Richter, Malsfeld-Beiseförth (DE)

(73) Assignee: HÜBNER GMBH & CO. KG, Kassel (DE)

( * ) Notice: Subject to any disclaimer, the term of this patent is extended or adjusted under 35 U.S.C. 154(b) by 333 days.

(21) Appl. No.: 15/746,987

(22) PCT Filed: Apr. 27, 2016

(86) PCT No.: PCT/EP2016/000682
§ 371 (c)(1),
(2) Date: Jan. 23, 2018

(87) PCT Pub. No.: WO2017/016620
PCT Pub. Date: Feb. 2, 2017

(65) Prior Publication Data
US 2018/0215399 A1 Aug. 2, 2018

(30) Foreign Application Priority Data
Jul. 24, 2015 (EP) ..... 15178284

(51) Int. Cl.
*B61G 5/02* (2006.01)
*B61F 5/52* (2006.01)
*B61F 3/02* (2006.01)

(52) U.S. Cl.
CPC ..... *B61F 5/52* (2013.01); *B61F 3/02* (2013.01); *B61G 5/02* (2013.01)

(58) Field of Classification Search
CPC ..... B60D 1/02; B61F 3/12; B61F 5/52; B61G 5/02
See application file for complete search history.

(56) References Cited

U.S. PATENT DOCUMENTS 1,574,453 A 2/1926 Suarez
3,399,631 A * 9/1968 Weber ..... B61D 3/10 105/4.1
4,962,861 A * 10/1990 Wiebe ..... B61D 3/14 105/4.1

(Continued)

FOREIGN PATENT DOCUMENTS

CH 444903 A 10/1967
CN 102416832 A 4/2012

(Continued)

OTHER PUBLICATIONS

International Search Report, International Application No. PCT/EP2016/000682, filed Apr. 27, 2016.

*Primary Examiner* — Scott A Browne
(74) *Attorney, Agent, or Firm* — Dinsmore & Shohl LLP

(57) ABSTRACT

An articulated connector for a rail vehicle having a plurality of rail car bodies including a first and a second rail car body supported on a bolster of a Jacobs bogie. The articulated connector includes a spherical joint mechanism connecting the first rail car body and the second car body to one another, the spherical joint mechanism having at least two spherical joint bearings, and the spherical joint mechanism being disposed on the bolster of the Jacobs bogie.

9 Claims, 5 Drawing Sheets

(56) References Cited

U.S. PATENT DOCUMENTS

| | | | | | |
|---|---|---|---|---|---|
| 5,014,626 | A * | 5/1991 | Schultz | B61F 5/16 | 105/3 |
| 5,131,331 | A * | 7/1992 | Lynch, Jr. | B61G 5/02 | 105/3 |
| 5,520,295 | A | 5/1996 | Wiebe | | |
| 5,560,503 | A * | 10/1996 | Daugherty, Jr. | B61G 5/02 | 213/75 R |
| 6,167,813 | B1 * | 1/2001 | Kaufhold | B61G 5/02 | 105/3 |
| 2011/0315041 | A1 * | 12/2011 | Al-Kaabi | B61G 5/02 | 105/4.1 |
| 2012/0074669 | A1 * | 3/2012 | Scharf | B60D 5/00 | 280/515 |

FOREIGN PATENT DOCUMENTS

| | | | | | |
|---|---|---|---|---|---|
| DE | 1605188 | A1 | 6/1971 | | |
| DE | 102007027592 | A1 * | 12/2008 | B61G 5/02 | |
| DE | 102007027592 | A1 | 12/2008 | | |
| EP | 0494323 | A1 * | 7/1992 | B61D 3/12 | |
| EP | 0520301 | A1 * | 12/1992 | B61F 5/16 | |
| EP | 1312527 | A1 | 5/2003 | | |
| GB | 1059062 | A | 2/1967 | | |
| WO | 2005023619 | A1 | 3/2005 | | |
| WO | WO-2005023619 | A1 * | 3/2005 | B61F 3/125 | |

* cited by examiner

RAIL VEHICLE WITH ARTICULATED CONNECTION

CROSS-REFERENCE TO RELATED APPLICATIONS

This application is the U.S. national stage of PCT/EP2016/000682 filed Apr. 27, 2016, which claims priority of European Patent Application 15178284.4 filed Jul. 24, 2015 of which is hereby incorporated by reference in its entirety.

FIELD OF THE INVENTION

The present invention relates to a rail vehicle having a plurality of rail car bodies, wherein a first and a second rail car body are supported on a bolster of a Jacobs bogie, wherein the rail car bodies are connected to one another by a spherical joint mechanism, with the spherical joint mechanism being arranged on the bolster.

BACKGROUND OF THE INVENTION

Rail vehicles having Jacobs bogies are sufficiently known from the prior art. The most famous here is the TGV in which two rail car bodies are supported on a Jacobs bogie in a gangway region.

Such a Jacobs bogie comprises a frame, with a respective set of wheels being arranged at the frame by primary springs at both ends of the frame. A so-called bolster that is supported on the frame by secondary springs is supported on the frame. The two rail car bodies are supported on the bolster by a spherical joint mechanism. Such a spherical joint mechanism for a Jacobs bogie is known from WO 2005/023619. However, the pitching movements and the kink movements, rolling movements and compensating movements are greatly restricted here. The reason for this can be found in the fact that only the one rail car body is movable relative to the other rail car body. The other rail car body is fixedly connected to the bolster so that it is rigid. This means that both pitching movements and kink, rolling and compensating movements are only permitted to a relatively small degree.

SUMMARY OF THE INVENTION

The underlying object of the invention consequently comprises providing a joint mechanism for a Jacobs bogie in a rail vehicle of the initially named kind, wherein the joint mechanism is able to compensate or absorb all the movements that occur during travel, also at larger angles, in particular such movements as pitching, rolling and kink movements as well as compensating movement such as occur when such vehicles travel over switch points.

In accordance with the invention, it is proposed to achieve the object that the joint mechanism has at least two spherical joint bearings. Provision is in particular made here that the two joint bearings are arranged in a plane with respect to one another, which brings about a space-saving construction so that the spacing between the rail car bodies, that is the length of the gangway between the two vehicles, can be selected as small, but so that e.g. substantial kink movements are nevertheless permitted.

A first variant of such a spherical joint mechanism in accordance with the invention having two spherical joint bearings is characterized in that the at least two joint bearings have a common pivot point. Provision is made in detail for this purpose that two ball segments supported in one another or on one another are provided to form the two joint bearings having such a common pivot point, wherein the outer ball segment is received by a bearing shell of a ball segment kind. Such a double-spherical joint mechanism is furthermore characterized in detail in that the inner ball segment has a connection member to the bolster of the Jacobs bogie. The connection member furthermore has a support for connection to the bolster. The outer ball segment has a saddle for connection to the one first rail car body, with the bearing shell being connected to the other second rail car body. Each of the two joint bearings is thus connected to a rail car body.

As already stated, the above-described double-spherical bearing is able to substantially absorb all the movements occurring during travel such as rolling, pitching, pivoting (kink) and compensating movements as well as combinations thereof, and indeed at comparatively large angles; however, this design has the disadvantage that the bolster is not free of torque under all circumstances. Such torques in particular arise when forces act in the direction of the longitudinal vehicle axis or of the transverse vehicle axis on the double-spherical joint mechanism in accordance with the invention whose pivot point is spaced apart from the surface of the bolster. Forces that act in the direction of the longitudinal vehicle axis on the joint mechanism at the level of the pivot point are ultimately those that arise on accelerating and decelerating the vehicles. Transverse forces, that is forces transverse to the longitudinal axis of the vehicle, arise due to centrifugal forces or so-called track guiding forces. Longitudinal and transverse forces are therefore horizontal forces. The torques from them have to be absorbed directly by the bolster. The reaction forces due to such torques are transmitted to the frame of the Jacobs bogie by the springs with which the bolster is supported on the frame. To avoid this, longitudinal arms and transverse arms, e.g. lemmiscate arms, can be provided between the bolster and the frame of the Jacobs bogie to avoid a deflection of the bolster on the frame. This means that substantially no reaction forces should be transmitted by the horizontally impacting forces to the springs by which the bolster is supported on the frame.

Another possibility of keeping the bolster supported by springs on the frame of the Jacobs bogie substantially free of torques due to the influence of longitudinal and transverse forces comprises, in accordance with a second variant of the spherical joint mechanism, the spherical joint mechanism having at least two joints in the direction of the vertical axis of the rail vehicle that are arranged spaced apart from and above one another. That is, two spherical joint bearings are provided that are in particular connected to one another by a spacer bolt. An upper ball joint is here provided as the spherical joint bearing and serves the connection to the two rail car bodies, with the lower ball joint being connected to the bolster of the Jacobs bogie. In detail, the bolster has a pot for receiving the lower ball joint in which the lower ball joint is supported as a spherical bearing. The support takes place here such that the lower spherical joint bearing is pivotably or rotationally movable relative to the pot. Since the lower spherical bearing is arranged in the pot in a pivotably articulated manner relative to the pot, longitudinal and transverse forces that are introduced into the upper spherical bearing by the rail car bodies and which would introduce torques into the bolster due to the lever arm generated by the spacer bolt between the two spherical joint bearings and per se can be substantially intercepted. This means that the bolster is substantially free of torque due to a joint mechanism which has spherical joint bearings arranged spaced apart from and above one another and with which the lower bearing is supported in a pivotably movable manner on the bolster of the Jacobs bogie.

It is advantageous in this connection for the two joint bearings arranged above one another to be installed such that they provide the respective greater surface, that is have the smallest bearing pressure, in the direction of the vertical load and of the supporting force. The two joint bearings are rotated by 180° with respect to one another to this extent.

BRIEF DESCRIPTION OF THE DRAWINGS

The invention will be described in more detail below by way of example with reference to the drawings.

DETAILED DESCRIPTION OF THE INVENTION

Figure 1:
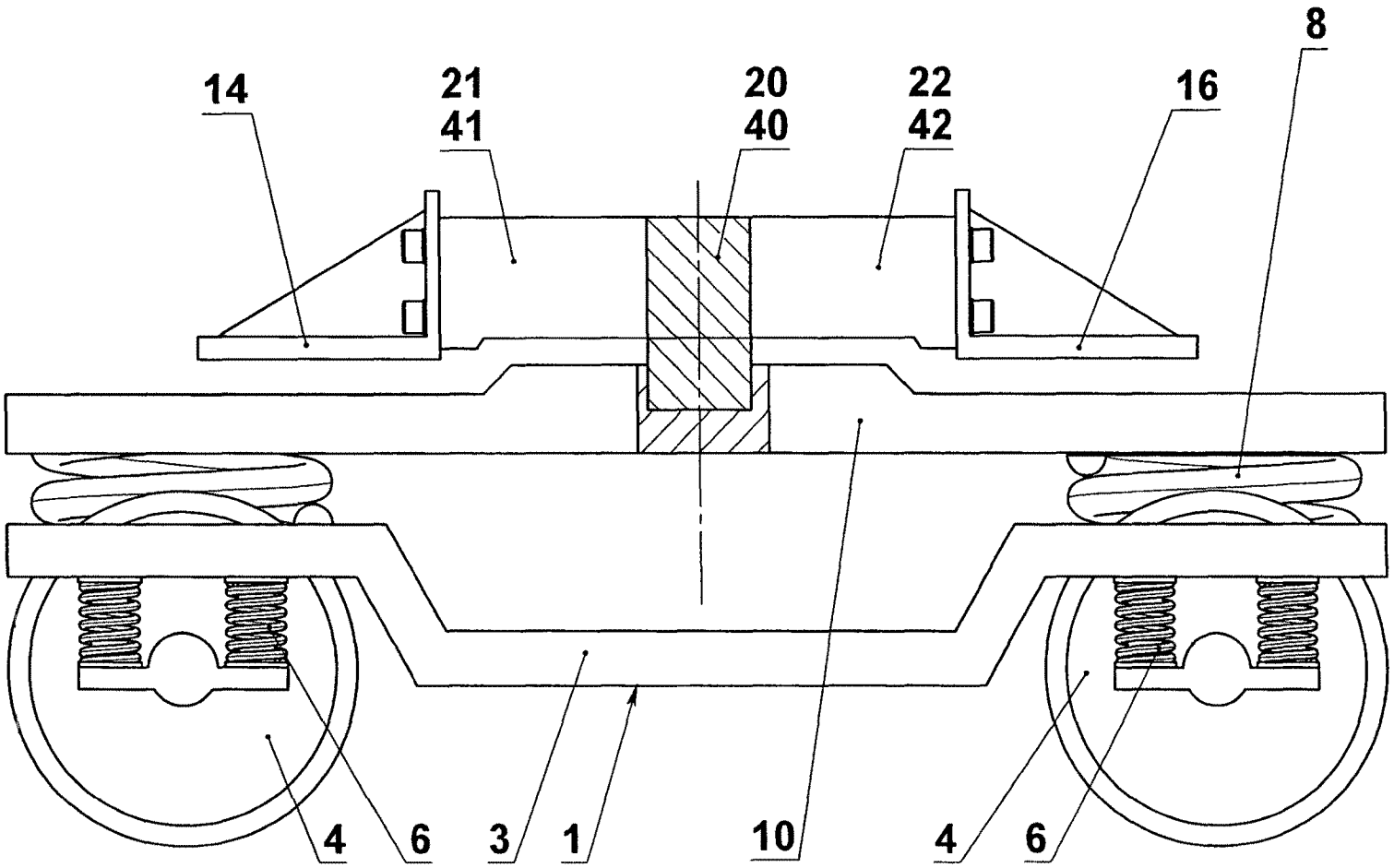
FIG. 1 schematically shows a Jacobs bogie in a side view, with the rotationally articulated connection between the two rail car bodies on the Jacobs bogie only being schematically indicated.

The Jacobs bogie 1 shown in FIG. 1 comprises the frame 3, wherein two wheel sets 4 are arranged at the frame 3 with primary springs 6. The bolster, designated as a whole by 10, is supported on four springs 8 on the frame 3. The spherical joint mechanism 20, 40 is arranged on the bolster 10, with the spherical joint mechanism 20, 40 being connected to the respective schematically indicated rail car bodies 14, 16 by joint arms 21, 22; 41, 42.

Figure 2A:
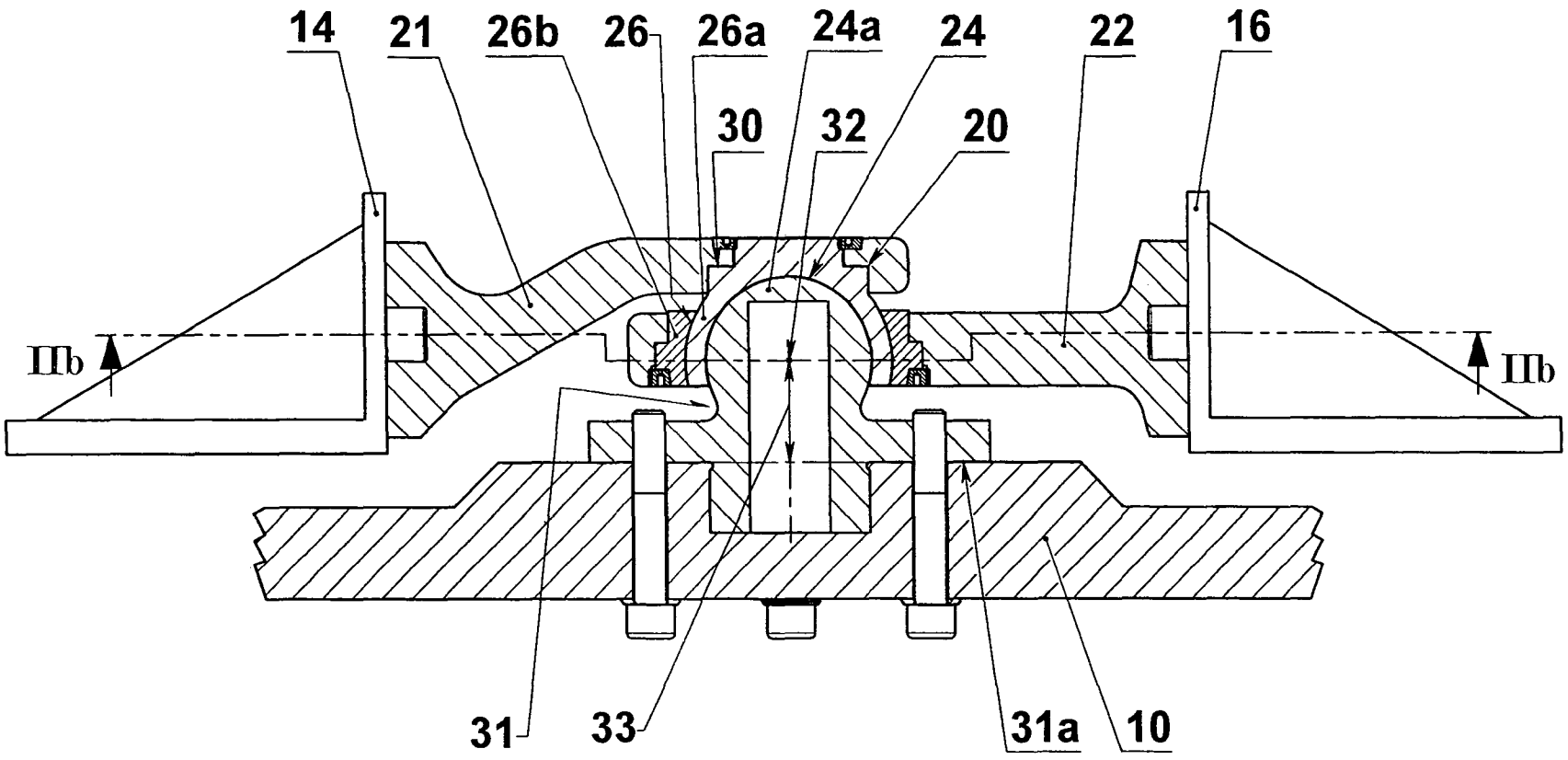
FIG. 2*a* shows a first variant of the spherical joint mechanism in section.
Figure 2B:
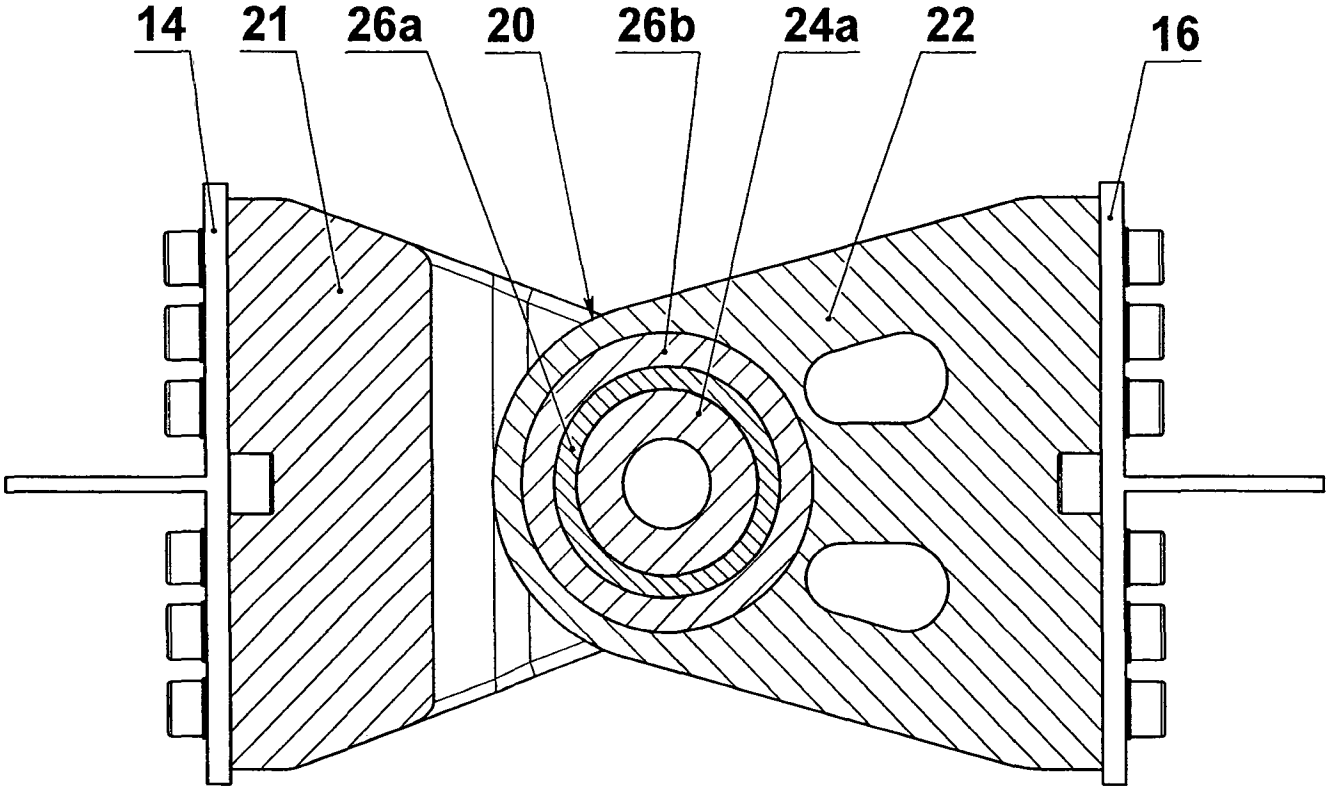
FIG. 2*b* shows a plan view of the joint mechanism of FIG. 2*a;*

The first variant of a spherical joint mechanism 20 shown in FIG. 2*a* and FIG. 2*b* is characterized by the two spherical joint bearings 24 and 26. The inner spherical joint bearing 24 comprises an inner ball segment 24*a* on which an outer ball segment 26*a* of the outer spherical joint bearing 26 is supported. The outer ball segment 26*a* of the outer spherical joint bearing 26 is supported in the bearing shell 26 that is of a ball segment kind and that is connected to the rail car body 16 by the joint arm 22. The outer ball segment 26*a* furthermore has a saddle 30 by which the outer ball segment 26*a* is connected to the rail car body 14 by the joint arm 21. The connection member 31 for connecting to the bolster 10 of the Jacobs bogie 1 is arranged at the inner ball segment 24*a*. The connection member 31 is provided with a support 31*a* for connecting to the bolster.

The spherical joint mechanism 20 has the common pivot point 32. A spacing 33 from the upper side of the bolster 10 is formed by the connection member 31 in conjunction with the support in the bolster. This spacing 33 forms a lever arm that exposes the bolster 10 to corresponding torques on the engagement of horizontal forces at the pivot point 32. The forces that engage at the pivot point 32, for example, include forces in the longitudinal direction of the vehicle, that is in particular forces on accelerating and decelerating the rail vehicle. Transverse forces in the horizontal direction arise due to the effect of centrifugal forces or also due to the effect of track guiding forces. To keep the bolster 10 free of torque to this extent, the bolster can be supported with respect to one another toward the frame of the Jacobs bogie by longitudinal and/or transverse arms, e.g. in the form of a lemmiscate arm.

Figure 3A:
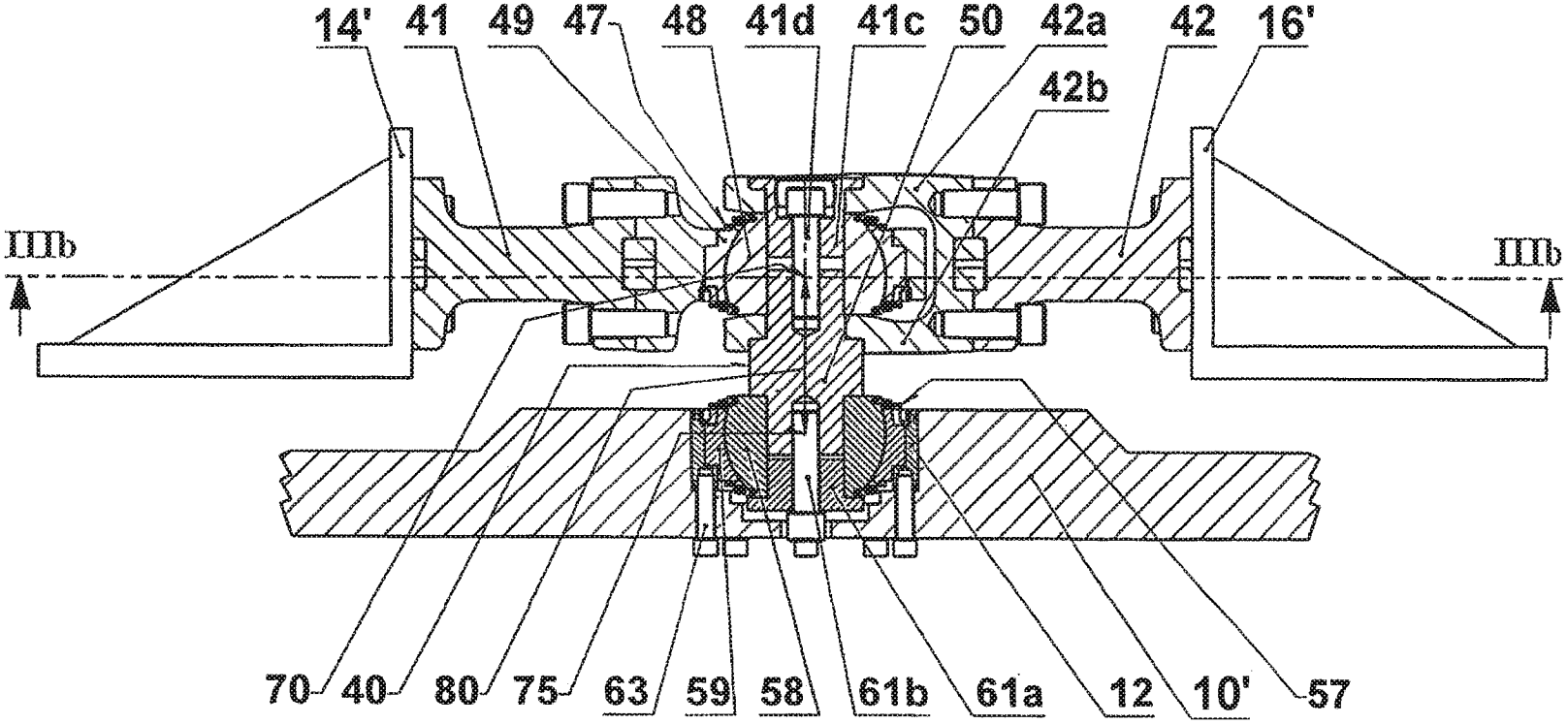
FIG. 3*a* shows a second variant of the spherical joint mechanism in section.
Figure 3B:
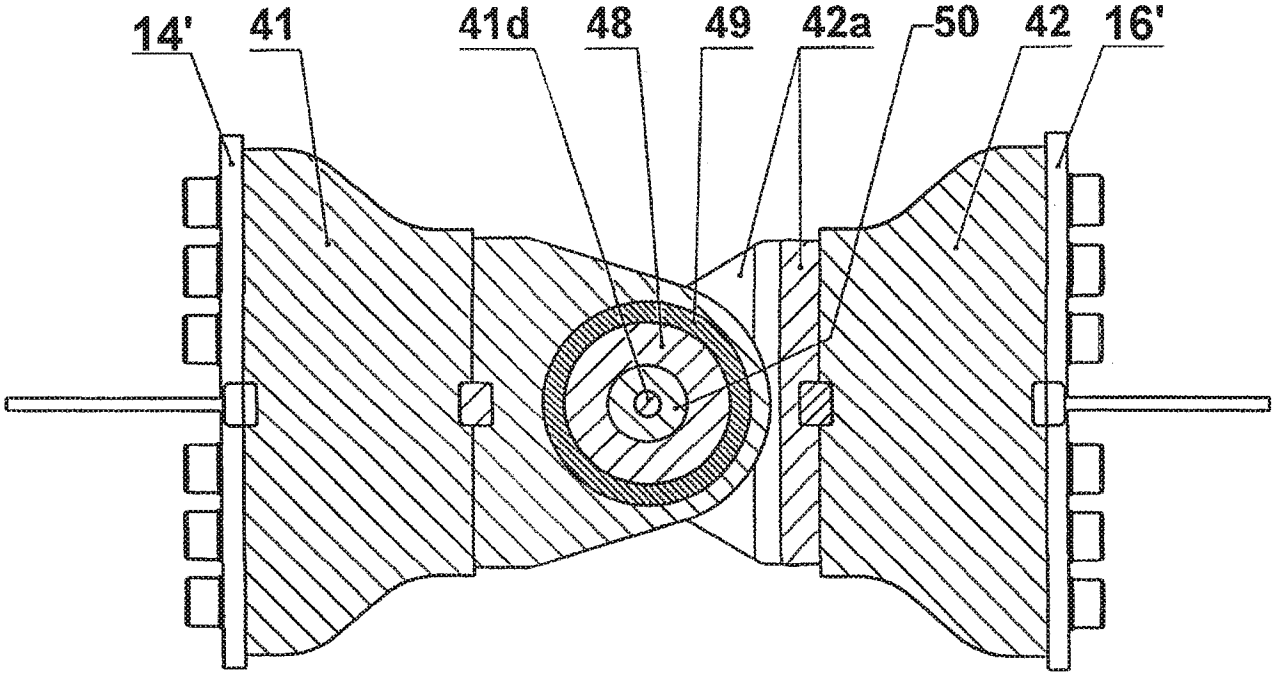
FIG. 3*b* shows a plan view of the joint mechanism of FIG. 3*a*.

The spherical joint mechanism 40 shown in FIGS. 3*a* and 3*b* is characterized by an upper spherical joint bearing 47 and by a lower spherical joint bearing 57; the two joint bearings are arranged spaced apart from and above one another to this extent. The two joint bearings 47 and 57 are connected to one another by the spacer bolt 50 to form the spacing. The lower spherical joint bearing is supported on the bolster 10' by the pot 12. The upper spherical joint bearing 47 in detail comprises a ball segment 48 that is supported in a bearing shell 49. The bearing shell 49 is connected by the joint arm 41 to the rail car body marked by 14'. The ball segment 48 in contrast is connected to the rail car body 16' by the joint arm 42. The lower spherical joint bearing 57 has the ball segment 58 that is held in the bearing shell 59. The bearing shell 49 is in turn supported in the pot 12 that is arranged in the bolster 10'.

The connection between the spherical joint bearing 47 and the spherical joint bearing 57 takes place, as already mentioned, by the spacer bolt 50. The joint arm 42 for connecting the spherical joint bearing 47 to the rail car body 16' is provided with two limbs 42*a* and 42*b* for receiving the ball segment 48 of the spherical joint bearing 47. The ball segment 48 is held between these two limbs 42*a* and 42*b* of the joint arm that is fork-like in this respect. The limb 42*a* receives a clamping member 41*c* that is connected to the spacer bolt 50 by a stud bolt 41*d*. The spacer bolt 50 in turn contacts the limb 42*b*. In the same manner, the lower spherical bearing 57 has a clamping member 61*a* that contacts the ball segment 58 and that is connected to the spacer bolt 50 by a stud bolt 61*b*. The bolster is connected by the stud bolt 63 to the pot 12 and thus to the lower spherical joint bearing 57.

Rolling, pitching, kink and compensating movements or also combinations of these movements can now be taken up and transmitted by the spherical joint mechanism 40 having the two joint bearings arranged above one another and spaced apart from one another; in addition, this design, however, also ensures that the bolster remains substantially free of torque on an engagement of horizontal forces. This results from the following:

The spherical joint bearing 47 has a pivot point 70; the spherical joint bearing 57 has the pivot point 75. The spacing between the two pivot points 70 and 75 is marked by 80 and forms a lever arm. If forces in a horizontal direction are now introduced into the pivot point 70 of the spherical joint mechanism 40, the ball segment 58 of the lower spherical joint bearing 57 can pivot in the bearing shell 59. This means that the torques arising due to the introduction of horizontal forces into the upper spherical joint bearing 47 are substantially intercepted by the lower spherical joint bearing 57, whereby the bolster 10' on which the spherical joint mechanism 40 is held by the pot 12 remains substantially free of torque.

REFERENCE NUMERAL LIST

1 Jacobs bogie
3 frame
4 wheel set
6 primary spring
8 spring
10, 10' bolster
12 pot
14, 14' rail car body

16, 16' rail car body
20 spherical joint mechanism (1st variant)
21 joint arm (of the rail car body)
22 joint arm (of the rail car body)
24 inner spherical joint bearing
24*a* inner ball segment
26 outer spherical joint bearing
26*a* outer ball segment
26*b* bearing shell
30 saddle
31 connection member
31*a* support
32 pivot point
33 spacing (lever arm)
40 spherical joint mechanism (2nd variant)
41 joint arm
41*c* clamping member
41*d* stud bolt
42 joint arm
42*a* limb of the joint arm
42*b* limb of the joint arm
47 spherical joint arm (top)
48 ball segment
49 bearing shell
50 spacer bolt
57 spherical joint bearing (bottom)
58 ball segment
59 bearing shell
61*a* clamping member
61*b* stud bolt
63 stud bolt
70 pivot point
75 pivot point
80 spacing (lever arm)

The invention claimed is:

1. An articulated connector for a rail vehicle having a plurality of rail car bodies including a first and a second rail car body supported on a bolster of a Jacobs bogie, the articulated connector comprising:

a spherical joint mechanism having a first joint with a spherical bearing articulably connecting the first rail car body and the second rail car body to one another, the spherical joint mechanism further having a second spherical joint with a spherical bearing articulably connecting the spherical bearing of the first joint to the bolster of the Jacobs bogie;

the first joint and the second joint being independently articulable; and the spherical joint mechanism being disposed on the bolster of the Jacobs bogie;

the first joint coupling the first and second rail car body and the second joint received within a portion of the Jacobs bogie;

wherein bearing surfaces of both joints surround a spacer bolt that extends between and interconnects the joints; and wherein each spherical bearing has a ball segment and a bearing shell surrounding the ball segment, the ball segment and bearing shell each being rotationally symmetrical.

2. The articulated connector of claim 1, wherein the spherical bearing of the first joint is an upper spherical bearing and the spherical bearing of the second joint is a lower spherical bearing, and the upper spherical bearing and the lower spherical bearing are arranged spaced apart from one another in a direction of a vertical axis of the rail vehicle.

3. The articulated connector of claim 2, wherein the lower spherical bearing is connected to the bolster of the Jacobs bogie.

4. The articulated connector of claim 3, wherein the bolster of the Jacobs bogie comprises a pot for receiving the lower spherical bearing.

5. The articulated connector according to claim 1, wherein the first joint is received within two opposing limbs of either the first or second rail car body and the spacer bolt extends through the limbs and is received in the Jacobs bogie.

6. A rail vehicle, comprising:

a plurality of rail car bodies including a first and a second rail car body;

a Jacobs bogie having a bolster, the first and second rail car body being supported by the bolster of the Jacobs bogie;

a spherical joint mechanism connecting the first and second rail car bodies with each other, the spherical joint mechanism being disposed on the bolster, the spherical joint mechanism comprising at least two spherical joints each having a spherical joint bearing, the spherical joints being spaced apart from one another in a direction of a vertical axis of the rail vehicle and the bearing surfaces of both joints surround a spacer bolt that extends between and interconnects the joints;

wherein each spherical bearing has a ball segment and a bearing shell surrounding the ball segment, the ball segment and bearing shell each being rotationally symmetrical.

7. The rail vehicle according to claim 6, wherein a first one of the spherical joints is an upper spherical joint connecting the first and second rail car bodies and a second one of the spherical joints is a lower spherical joint connecting the spherical joint mechanism with the bolster of the Jacobs bogie.

8. The rail vehicle according to claim 7, wherein the bolster of the Jacobs bogie comprises a pot for receiving the lower spherical joint.

9. The rail vehicle according to claim 6, wherein the bearing of the upper spherical joint and the bearing of the lower spherical joint are rotated by 180° with respect to one another.

* * * * *